US010202670B2

(12) United States Patent
Park et al.

(10) Patent No.: US 10,202,670 B2
(45) Date of Patent: Feb. 12, 2019

(54) ALUMINUM ALLOY FOR CONTINUOUS CASTING AND METHOD FOR PRODUCING THE SAME

(71) Applicants: Hyundai Motor Company, Seoul (KR); Kia Motors Corporation, Seoul (KR)

(72) Inventors: Hoon Mo Park, Gyeonggi-Do (KR); Hyuk Kang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 158 days.

(21) Appl. No.: 15/264,281

(22) Filed: Sep. 13, 2016

(65) Prior Publication Data

US 2017/0002443 A1 Jan. 5, 2017

Related U.S. Application Data

(62) Division of application No. 13/599,055, filed on Aug. 30, 2012, now Pat. No. 9,469,888.

(30) Foreign Application Priority Data

Nov. 28, 2011 (KR) ..... 10-2011-0125049

(51) Int. Cl.

| | |
|---|---|
| ***B22D 11/00*** | (2006.01) |
| ***C22C 21/02*** | (2006.01) |
| ***C22C 21/04*** | (2006.01) |
| ***B22D 1/00*** | (2006.01) |

(52) U.S. Cl.

CPC ..... *C22C 21/02* (2013.01); *B22D 1/00* (2013.01); *B22D 11/003* (2013.01); *C22C 21/04* (2013.01)

(58) Field of Classification Search

CPC ..... B22D 11/003; B22D 41/00; C22C 21/02

See application file for complete search history.

(56) References Cited

U.S. PATENT DOCUMENTS 5,180,447 A 1/1993 Sigworth et al.
6,261,390 B1 * 7/2001 Yeh ..... C22C 1/03 148/549

FOREIGN PATENT DOCUMENTS

| | | | | |
|---|---|---|---|---|
| JP | 56001253 A | * | 1/1981 | ..... B22D 11/064 |
| JP | 63-247334 A | | 10/1988 | |
| JP | 04202737 A | | 7/1992 | |
| JP | 06-192780 A | | 7/1994 | |
| JP | 2004-523357 A | | 8/2004 | |

(Continued)

OTHER PUBLICATIONS

Aluminum and Aluminum Alloys, ASM International, 1993, p. 41.

*Primary Examiner* — George Wyszomierski
*Assistant Examiner* — Janelle Morillo
(74) *Attorney, Agent, or Firm* — Mintz Levin Cohn Ferris Glovsky and Popeo, P.C.; Peter F. Corless

(57) ABSTRACT

The present disclosure provides an aluminum (Al) alloy for continuous casting, and a method of making the same. The Al alloy includes Al, Si in the range of 14 to 20 wt %, Ti in the range of 2 to 7 wt % and B in the range of 1 to 3 wt %. According to the disclosure, $TiB_2$ compound may be formed in the alloy, where the ratio of Ti:B may range from 2 to 2.5 wt %. By a process of continuously casting the molten metal, an aluminum alloy with improved elasticity may be produced.

3 Claims, 1 Drawing Sheet

(56) References Cited

FOREIGN PATENT DOCUMENTS

| | | | |
|---|---|---|---|
| KR | 10-2004-0068021 | A | 7/2004 |
| KR | 10-2005-0118299 | A | 12/2005 |
| WO | 01/88215 | A1 | 11/2001 |

* cited by examiner

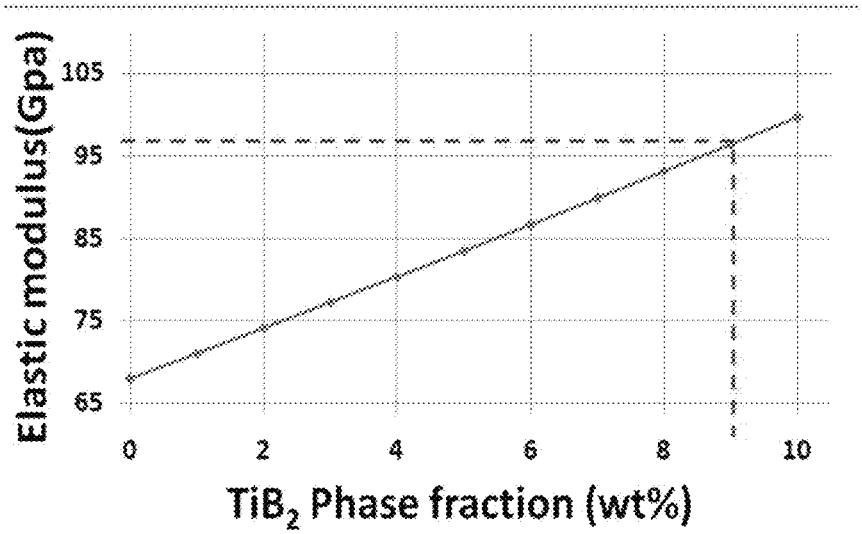
Elastic modulus(Gpa)
105
95
85
75
65
0
2
4
6
8
10
TiB2 Phase fraction (wt%)

ALUMINUM ALLOY FOR CONTINUOUS CASTING AND METHOD FOR PRODUCING THE SAME

CROSS-REFERENCE TO RELATED APPLICATION

This application is a divisional application of U.S. application Ser. No. 13/599,055, filed Aug. 30, 2012 which claims under 35 U.S.C. § 119(a) the benefit of Korean Patent Application No. 2011-0125049 filed on Nov. 28, 2011, the entire contents of which are incorporated herein by reference.

BACKGROUND (a) Technical Field

The present disclosure relates to an aluminum alloy. More particularly, the present disclosure relates to an aluminum allow produced by a continuous casting technique that bestows improved elasticity characteristics to the resulting aluminum alloy, and a method for producing the same.

(b) Background Art

Aluminum alloys improve the properties of aluminum and displays many excellent properties, which can be varied according to the composition of the alloy. For example, high strength aluminum alloys, such as duralumin, can be made by including copper, which provides high strength characteristics to the alloy. Increasing the copper content in the alloy has the effect of increasing the strength of the alloy. For example, super duralumin is created by adding copper to the duralumin, and extra super duralumin is created by adding copper to super duralumin. Extra super duralumin is used as an aircraft material. Disadvantageously, such high strength aluminum-copper (Al—Cu alloys such as duralumin lack the ability to resist corrosion (i.e. they are prone to corrosion). Structural aluminum alloys are typically made by adding magnesium and zinc, which confer excellent corrosion resistance properties to the alloys. Accordingly, such structural aluminum alloys are used for railway vehicles, bridges, and the like. Aluminum alloy for casting can be made by adding Si, and other metals can be mixed with Al to create alloys with a variety of other properties, such as heat-resistance and brilliance.

Aluminum alloys are largely divided into two groups: alloys for wrought material and alloys for casting material. The former group includes Al—Cu—Mg-based alloys (e.g., duralumin, super duralumin), Al—Mn-based alloys, Al—Mg—Si-based alloys, Al—Mg-based alloys, and Al—Zn—Mg-based alloys (extra super duralumin) alloys. The latter group includes Al—Cu-based alloys, Al—Si-based alloys (silumin), Al—Cu—Si-based alloys (lautal), Al—Mg-based alloys (hydronalium), Al—Cu—Mg—Si-based alloys (Y alloy), and Al—Si—Cu—Mg—Ni-based alloys (Lo•Ex alloy).

Recently, attempts have been made to generate a metal-based compound reinforced with carbon nanotubes (CNT) molded in a powder form, however, use of such a compound is limited because of its high cost. Disadvantageously, when it was applied to a casting process in a powder form, major problems were encountered with dispersion of the powder in an Al matrix. A further disadvantage results from a hypereutectic aluminum casing material that can only be made by a low pressure casting process. A further disadvantage is that processing such a material with coarse Si particles poses additional manufacturing difficulties. For example, when Si is used to increase the elasticity of a metal-based compound, or a reinforced CNT material molded in a powder form, the coarse Si particles limited the ability to improve elasticity, due in part to problems with the wetability when combined with the Al matrix, which resulted in uneven dispersion of the CNT powder when used for a continuous casting process. Additionally, the ability to work with such materials is cost prohibitive.

Accordingly, there is a need in the art for an aluminum alloy with high elasticity for use as a casting aluminum material to with improved the rigidity and noise, vibration, and harshness (NVH) characteristics.

SUMMARY OF THE DISCLOSURE

The present invention provides a continuous casting aluminum alloy for use as a high elastic continuous casting aluminum material with improved rigidity and noise, vibration, and harshness (NVH) characteristics, and a method for producing the same.

An aluminum alloy according to an exemplary embodiment of the present invention includes Al as a major component, Si in the range of 14 to 20 wt %, Ti in the range of 2 to 7 wt % and B in the range of 1 to 3 wt %, and a $TiB_2$ compound can be formed therein.

According to an exemplary embodiment of the present invention the aluminum alloy can have a composition including Al as a major component, Si in the range of 14 to 20 wt %, Ti in the range of 2 to 7 wt %, B in the range of 1 to 3 wt %, Fe in the range of 0.5 wt % or less (not including 0), Cu in the range of 4 to 5 wt %, Mn in the range of 0.1 wt % or less (not including 0), Mg in the range of 0.45 to 0.65 wt %, Zn in the range of 0.1 wt % or less (not including 0), and other indispensable impurities According to an exemplary embodiment of the present invention, the ratio of B:Ti may be 1:2 to 2.5.

According to an exemplary method for producing the aluminum alloy, the aluminum alloy may be prepared by mixing a molten Al—Ti-based alloy comprising Ti in the range of 5 to 10 wt % and a molten Al—B-based alloy comprising B in the range of 2 to 10 wt % together. Furthermore, the Al—Ti-based alloy and the Al—B-based alloy can be mixed to the molten metal and melted, and then be used for a continuous casting process to produce the aluminum alloy.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIG. 1 is a graph representing the elasticity of the aluminum alloys for continuous casting according to an exemplary embodiment of the present invention according to the $TiB_2$ content.

It should be understood that the appended drawings are not necessarily to scale, presenting a somewhat simplified representation of various preferred features illustrative of the basic principles of the invention. In the FIGURES, reference numbers refer to the same or equivalent parts of the present invention throughout the several FIGURES of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that the present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Hereinafter, an aluminum alloy for continuous casting and a method for producing the same according to the preferred embodiments of the present invention will be described in detail with reference to the accompanying drawings.

The aluminum alloy for continuous casting according to the present invention has a composition comprising: Al as a major component, Si in the range of 14 to 20 wt %, Ti in the range of 2 to 7 wt % and B 1~3 wt % so as to form a $TiB_2$ compound.

The present invention provides a high elastic casting aluminum material with improved rigidity and NVH characteristic. Conventionally, when only using Si for high elasticity, there were problems with restricted elasticity improvement and processability as a result of the coarse Si particles. A metal-based compound or a reinforced phase such as CNT was molded with a powder form, but it had a very limited usefulness as a result of the fact that the material was prohibitively expensive, and because of problems with the wetability of an Al matrix and the resulting dispersion problems that arose when the material was applied to a continuous casting process as the powder form.

The present invention implements a boride compound to provide an aluminum alloy having high elasticity, which can maximize improvement of the uniformity and elasticity of the alloy by rapid cooling rate as an advantage of the continuous casting.

According to an exemplary embodiment of the present invention, the Si content may be significantly increased to 14 to 20 wt % using a rapid cooling rate, which is an advantage of the continuous casting method. In order to form a boride compound such as $TiB_2$ (541 GPa), which is the most effective compound to improve alloy elasticity, a basic alloy system comprising Ti in the range of 2 to ~7 wt % and B in the range of 1 to 3 wt % was used. This compound was found to maximize the observed increase in elasticity. Further, in addition to the aluminum alloy, an alloy may also be prepared by adding Ti in the range of 2 to ~7 wt % and B in the range of 1 to 3 wt % to A390 alloy, which is the most representative of alloy systems for use in continuous casting. According to an exemplary embodiment of the present invention, in order to maximize the boride production, the ratio of Ti to B is controlled to about 2 to 2.5. In order to control the ratio of Ti to B, a powder is not injected, rather, the ratio is formed naturally in the molten metal using master aluminum alloys of Al-(5 to 10 wt %)Ti and Al-(2 to 10 wt %)B, so as to secure the material uniformity.

According to an exemplary embodiment of the present invention, the elasticity and properties (strength, wear-resistance, processability and the like) of the aluminum alloy may be improved by uniform distribution of a micro-$TiB_2$ phase and by boride production maximization, and the Si content can increase and the structure can be micronized by rapid cooling rate of the continuous casting.

For example, the elasticity coefficient of the aluminum alloy (micro-$TiB_2$ 1.45%) of an exemplary embodiment of the present invention significantly increased to 102.8 GPa as compared with the conventional aluminum alloy (Si 16 wt %, elasticity coefficient 85 GPa). Moreover, in case of micro-$TiB_2$ 3.21%, the elasticity coefficient was measured to 106.1 GPa.

According to an exemplary embodiment of the present invention, the aluminum alloy may have a composition comprising: Al as a major component, Si: in the range of 14 to 20 wt %, Ti in the range of 2 to 7 wt %, B in the range of 1 to 3 wt %, Fe in the range of 0.5 wt % or less (not including 0), Cu in the range of 4 to 5 wt %, Mn in the range of 0.1 wt % or less (not including 0), Mg in the range of 0.45 to 0.65 wt %, Zn in the range of 0.1 wt % or less (not including 0), and other indispensable impurities. Additionally, the ratio of B:Ti may be 1:2~2.5 to maximize the elasticity increase.

Exemplary compositions of the aluminum alloy of the present invention and the alloy of Comparative Example are listed in the following Tables.

TABLE 1

| | | | Fe | Cu | Mn | Mg | Zn | | | Al |
|---|---|---|---|---|---|---|---|---|---|---|
| Comparative Example | A390 | 16~18 | 0.5 | 4.0~5.0 | 0.1 | 0.45~0.65 | 0.1 | 0.2 | — | Bal. |
| Example | Present Invention | 14~20 | — | — | — | — | — | 2~7 | 1~3 | Bal. |
| | Example | 16~18 | 0.5 | 4.0~5.0 | 0.1 | 0.45~0.65 | 0.1 | 2~7 | 1~3 | Bal. |

In Comparative Example having the disclosed composition, the elasticity coefficient was measured to 85 GPa, but in the Example, the elasticity coefficients were measured to 102.8 GPa and 106.1 GPa.

The following Table 2 represents the optimized composition for maximizing the boride compound production.

TABLE 2

| | | Ti:B = 1:1 | | Ti:B = x:1 | |
|---|---|---|---|---|---|
| | | Alloy | $TiB_2$ | Alloy | $TiB_2$ |
| B Content | 1 wt % | Al—1Ti—1B | 1.45 | Al—2.3Ti—1B | 3.21 |
| | 2 wt % | Al—2Ti—2B | 2.9 | Al—4.5Ti—2B | 6.3 |
| | 3 wt % | Al—3Ti—3B | 4.36 | Al—6.7Ti—3B | 9.64 |

As shown in Table 2, the $TiB_2$ phase fraction increased to 9.64 by increasing the B and Ti contents, and the elasticity also increased.

FIG. 1 is a graph representing the elasticity of the aluminum alloys for continuous casting according to an exemplary embodiment of the present invention r to the $TiB_2$ content, and it is confirmed that when the $TiB_2$ phase fraction was 9.64%, the elasticity coefficient increased 45% from 68 GPa to 98.5 GPa.

In the method for producing the aluminum alloy for continuous casting, the aluminum alloy can be prepared by mixing a molten Al—Ti-based alloy comprising Ti in the range of 5 to 10 wt % and a molten Al—B-based alloy comprising B in the range of 2 to 10 wt % together. Here, an injecting rate of Al—Ti based alloy and Al—B based alloy may be adjusted in order for the composition ratio of B:Ti, as described-above, to be 1:2~2.5.

The continuous casting method is a casting method continuously injecting a molten metal into a template and solidifying thereof, and it is commonly used for producing plate, rod, and line-shaped billets. In continuous casting, a long billet of several meters to several tens of meters can be made by continuously pouring from the upper part of the template, pulling out the bottom face of the template, and continuously dragging the solidified ingot downward and out while quenching with cool water. When alloying using the continuous casting method, temperature control of a tundish, located between the ladle and the mold, is essential due to the shift variable of the melting material (Al—Si—Mg—Cu) while solidifying.

When the alloyed molten metal is discharged into the tundish from the ladle, the tundish entrance is heated to a temperature of at least 650° C. or more to prevent the molten metal from being quenched and solidified to the side wall, and the temperature of the tundish outlet port is maintained in the range of 300° C. to 350° C. to maintain the molten state. These conditions prevent the continuously poured melt at the upper part from flowing downward so as to keep the billet shape. Because this method has a rapid cooling rate as compared with other casting methods, it is advantageous for increasing the content of the solute atom and to secure the structure micronization and the uniformity. The Al—Ti-based alloy and the Al—B-based alloy can be added to the molten metal and melted, and then put through a continuous casting process to produce the aluminum alloy.

According to the aluminum alloy for continuous casting and the method for producing the same consisting of the structure described above, the elasticity and properties (strength, wear-resistance, processability and the like) of the aluminum alloy are improved by uniform distribution of the micro-$TiB_2$ phase and by boride production maximization. Further, the increased Si content and structure micronization is possible by the rapid cooling rate of the continuous casting process, which maximizes the improvement of the elasticity and properties.

While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

What is claimed is:

1. A method for producing an aluminum alloy for continuous casting comprising:

mixing a molten Al-Ti-based alloy comprising Ti in the range of 5 to 10 wt % and a molten Al—B-based alloy comprising B in the range of 2 to 10 wt % together to form the aluminum alloy, wherein the aluminum alloy comprises Al, Si in the range of 16 to 20 wt %, Ti in the range of 2 to 7 wt %, B in the range of 1 to 3 wt %, Fe in the rage of 0.5 wt % or less, Cu in the range of 4 to 5 wt %, Mn in the range of 0.1 wt % or less, Mg in the range of 0.45 to 0.65 wt %, and Zn in the range of 0.1 wt % or less, wherein the amount of Fe, Mn, and Zn of the aluminum alloy if more than 0 wt %, wherein the ratio of B:Ti of the alumnium alloy is 1:2 to 2.5 to form a $TiB_2$ compound.

2. The method of claim 1, wherein the molten AlTi and AlB are mixed in a tundish.

3. The method of claim 1, further comprising continuously casting the molten metal, thereby producing the aluminum alloy.

* * * * *